US006714227B2

(12) United States Patent
Honma et al.

(10) Patent No.: US 6,714,227 B2
(45) Date of Patent: Mar. 30, 2004

(54) IMAGE FORMING APPARATUS AND METHOD, AND TRANSFERRING MEDIUM CASSETTE

(75) Inventors: Nobuaki Honma, Tokyo (JP); Tomoyuki Marugame, Tokyo (JP); Tomoko Mita, Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 0 days.

(21) Appl. No.: 10/259,428

(22) Filed: Sep. 30, 2002

(65) Prior Publication Data

US 2003/0025781 A1 Feb. 6, 2003

Related U.S. Application Data

(63) Continuation of application No. PCT/JP00/06502, filed on Sep. 22, 2000.

(30) Foreign Application Priority Data

Mar. 31, 2000 (JP) ..... 2000-098462

(51) Int. Cl.[7] ..... B41J 2/325

(52) U.S. Cl. ..... 347/213; 347/222

(58) Field of Search ..... 347/213, 214, 347/171, 172, 174, 176, 197, 222; 400/120.01, 120.02, 120.04, 120.16

(56) References Cited

FOREIGN PATENT DOCUMENTS

| | | |
|---|---|---|
| JP | 5-270022 | 10/1993 |
| JP | 7-89174 | 4/1995 |
| JP | 8-48047 | 2/1996 |
| JP | 8-324005 | 12/1996 |
| JP | 9-66617 | 3/1997 |
| JP | 10-16260 | 1/1998 |
| JP | 10-129065 | 5/1998 |
| JP | 2000-15854 | 1/2000 |

OTHER PUBLICATIONS

PCT International Preliminary Examination Report dated Feb. 27, 2002.

*Primary Examiner*—Huan Huu Tran

(57) ABSTRACT

In an image forming apparatus using an indirect transferring method, an ink ribbon is selectively heated by a thermal head, in a state where an intermediate transfer film and the ink ribbon are put one on the other on a platen roller, so that a record-image is formed as a mirror image on an image-forming layer of the intermediate transfer film. Then, the intermediate transfer film and a target object are supplied with heat and pressure between a heating roller and a pressure roller, so that the record-image is transferred along with the image-forming layer of the intermediate transfer film to the target object. The intermediate transfer film and the ink ribbon are respectively accommodated in cassettes detachably mounted in the apparatus, and are used for forming the record-image while being fed from the cassettes.

15 Claims, 7 Drawing Sheets

IMAGE FORMING APPARATUS AND METHOD, AND TRANSFERRING MEDIUM CASSETTE

CROSS-REFERENCE TO RELATED APPLICATIONS

This is a Continuation Application of PCT Application No. PCT/JP00/06502, filed Sep. 22, 2000, which was not published under PCT Article 21(2) in English.

This application is based upon and claims the benefit of priority from the prior Japanese Patent Application No. 2000-098462, filed Mar. 31, 2000, the entire contents of which are incorporated herein by reference.

BACKGROUND OF THE INVENTION

1. Field of the Invention

The present invention relates to an image forming apparatus and method, and a transferring medium cassette used in the image forming apparatus. The image forming apparatus and method utilize an indirect transferring method, in which a record-image is once formed on an intermediate transferring medium, then a layer including the formed record-image is transferred from the intermediate transferring medium to a target object, which requires image formation, such as a card-, sheet-, booklet-, or disk-like object (though the shape is not necessarily limited).

2. Description of the Related Art

An indirect transferring method is known, in which a mirror image of a record-image is formed on the image-forming layer of an intermediate transferring medium, and then the record-image is transferred onto a target object to form a normal image of the record-image. In this method, for example, the used intermediate transferring medium is formed of an intermediate transfer film having a film-like long substrate and the image-forming layer, which is disposed on the substrate and capable of being transferred onto the target object by separation from the substrate. For example, this method is utilized along with an image forming technique for forming a gradated and especially multi-colored image by means of thermal fusion transfer, thermally adhesive film separation transfer or the like, using a dot-on-dot method (a method of stacking differently colored dots one on another at substantially the same position to obtain a predetermined color) and an area gradation method (a method of setting gradations based on the dot sizes in pixels), or by means of sublimation transfer using a density gradation method, which utilizes thermal sublimation of sublimation dyes.

Specifically, in the primary transfer, only the ink layer of an ink ribbon, or sublimation dyes for sublimation transfer are selectively transferred to an intermediate transfer film by a thermal head, so that a record-image is formed. Then, the intermediate transfer film with the record-image is put on a target object, and is supplied with heat and pressure by a heating and pressing mechanism to perform the secondary transfer. By doing so, the record-image is transferred along with the image-forming layer from the intermediate transfer film onto the target object. Then, the intermediate transfer film is separated from the target object, so that the transfer of the record-image onto the surface of the target object is completed.

With this method, it is possible to transfer a record-image onto various kinds of objects, such as paper materials (normal paper, fine quality paper, art paper, synthetic paper, processed paper, etc.), plastic goods, metal goods, glass materials, and ceramics. Accordingly, an image can be formed on various kinds of target objects, such as booklets, e.g., bankbooks and passports, and other items, of, e.g., sheet or card.

FIG. 1 is a schematic structural view showing an image forming apparatus using a conventional indirect transferring method, while putting emphasis on the path of an intermediate transfer film and an ink ribbon in use.

As shown in FIG. 1, an intermediate transfer film 3 and an ink ribbon 4 pass between a thermal head 1 and a platen roller 2, which work as an image forming mechanism. The ink ribbon 4 is selectively heated by the thermal head 1 while the intermediate transfer film 3 and the ink ribbon 4 are put one on the other on the platen roller 2, so that a mirror image of a record-image is formed on the image-forming layer 10 (see FIG. 9) of the intermediate transfer film 3.

The intermediate transfer film 3 further passes between a heating roller 5 and a pressure roller 6, which work as a heating and pressing mechanism, and is set in a state where it is put around a guide roller 7 and a separation roller 8. A target object 9 is set on the right side in FIG. 1, and is sent between the heating roller 5 and the pressure roller 6. The intermediate transfer film 3 and the target object 9 are supplied with heat and pressure between the heating roller 5 and the pressure roller 6, so that the image-forming layer 10 of the intermediate transfer film 3 is transferred along with the record-image onto the target object 9.

In such an image forming apparatus, especially when the intermediate transfer film 3 is set, there is a case where the intermediate transfer film 3 is set at an improper position in the width direction, thereby disturbing the path of the film.

FIG. 2 is a perspective view showing a setting method of the intermediate transfer film 3, using the method above. When the intermediate transfer film 3 is replaced, the distal end of the outermost surface of the intermediate transfer film 3 is first fixed to a take-up reel 11 by a fixing tape 15 or the like. Then, a pay-off reel 13 is put and set on a pay-off axis connector 14 provided in the apparatus. Then, the take-up reel 11 is put and set on a take-up axis connector 12 provided in the apparatus, thereby completing the setting.

In another setting method (not shown), the pay-off reel 13 is first put and set on the pay-off axis connector 14 provided in the apparatus. Then, the take-up reel 11 is put and set on the take-up axis connector 12. Then, the distal end of the outermost surface of the intermediate transfer film 3 is fixed to the take-up reel 11 by a fixing tape 15 or the like, thereby completing the setting.

In either case of the setting methods described above, since the path of the intermediate transfer film 3 is long and not linear, it is difficult to properly (accurately) set the orientation of the transfer film at the position fixed by the fixing tape 15, thereby likely causing variations therein. Consequently, as shown in FIG. 3A, the intermediate transfer film 3 shifts in the width direction relative to a target object 9, when they are near a position directly below the heating roller 5 for performing secondary transfer. As a result, an image-forming layer 10 to be transferred shifts or crinkles on the target object 9, thereby bringing about transfer errors, such as a transfer positional shift 16 shown in FIG. 3B, or a transfer crinkle 17 shown in FIG. 3C.

In the case of image formation performed by thermal transfer using the dot-on-dot method and an area gradation method, it is important to accurately position and set the intermediate transfer film 3 to have a proper orientation. If the set orientation of the intermediate transfer film 3 positionally shifts, it is difficult to accurately stack differently colored ink dots at a predetermined position, thereby bringing about a problem in that hardly any high quality image with predetermined color or gradation can be obtained.

Furthermore, when the setting method described with reference to FIG. 2 is performed, key parts of image formation, such as the thermal head 1 and the platen roller 2, which are disposed near the path of the ink ribbon 4 and the intermediate transfer film 3, are contaminated directly or indirectly with foreign substances 18 and 19 (see FIG. 1, though they are exaggerated), such as dust and grease, which have stuck to the operator's hands, clothes, and so forth. As a result, an image transferred to a target object is caused by the foreign substances 18 and 19 to have image defects 20 and 21 in the finally transferred matter, as shown in FIGS. 3D and 3E.

In the apparatus shown in FIG. 1, the ink ribbon 4 is also set by a method as in the intermediate transfer film 3. Consequently, also when the ink ribbon 4 is set, key parts of image formation in the apparatus are stained with foreign substances from operator's hands, clothes, and so forth, thereby bringing about image defects 20 and 21 in the finally transferred matter, as shown in FIGS. 3D and 3E.

BRIEF SUMMARY OF THE INVENTION

An object of the present invention is to provide an image forming apparatus and method, and a transferring medium cassette used in the image forming apparatus, which reduce the possibility of staining key parts of the image forming apparatus with foreign substances, when setting a long film-like article, such as an intermediate transfer film or an ink ribbon, which is consumed during formation of a record-image.

Another object of the present invention is to provide an image forming apparatus and method, and a transferring medium cassette used in the image forming apparatus, which allow a long film-like article, such as an intermediate transfer film or an ink ribbon, which is consumed during formation of a record-image, to be accurately set without dependence on the operator's skill.

According to a first aspect of the present invention, there is provided an image forming apparatus comprising:

- a mechanism configured to supply and drive a long film-like ink ribbon having an ink layer for performing thermal transfer recording;
- a mechanism configured to supply and drive a long film-like transferring medium having an image-forming layer, which allows thermal transfer recording to be performed, using the ink ribbon, and is separable from a substrate;
- a platen configured to support the transferring medium when thermal transfer recording is performed on the image-forming layer, using the ink ribbon;
- a thermal head configured to selectively heat the ink layer of the ink ribbon in a state where the transferring medium and the ink ribbon are put one on the other on the platen, thereby selectively transferring a thermal transfer recording material onto the image-forming layer to form a record-image on the image-forming layer; and
- a heating and pressing mechanism configured to apply heat and pressure to the transferring medium having the record-image and a target object, in a state where the transferring medium and the target object are put one on the other, thereby transferring the record-image along with the image-forming layer from the transferring medium to the target object;
- wherein at least one long film-like article to be consumed when the record-image is formed on the image-forming layer is accommodated in a cassette detachably mounted in the apparatus, and the long film-like article is used for forming the record-image while being fed from the cassette mounted in the apparatus.

In a second aspect of the present invention, there is provided an apparatus according to the first aspect, wherein the cassette includes a casing, a pay-off shaft rotatably disposed on the casing to support the long film-like article in a virgin state put therearound, and a take-up shaft rotatably disposed on the casing to wind up the long film-like article in a spent state.

In a third aspect of the present invention, there is provided an apparatus according to the second aspect, wherein the cassette includes openings respectively formed on two opposite surfaces of the casing between the pay-off shaft and the take-up shaft, such that an operation head of the apparatus for the long film-like article comes into the casing through one of the openings and pushes the long film-like article out of the casing through the other of the openings, when the long film-like article is used for forming the record-image.

In a fourth aspect of the present invention, there is provided an apparatus according to the second or third aspect, wherein the pay-off shaft and the take-up shaft are detachably disposed on the casing to allow the cassette to be refilled with a long film-like article.

In a fifth aspect of the present invention, there is provided an apparatus according to any one of the second to fourth aspects, wherein the apparatus comprises first and second axis connectors configured to respectively attach the pay-off shaft and the take-up shaft thereto, the second axis connector functioning as a driving shaft to drive the long film-like article.

In a sixth aspect of the present invention, there is provided an apparatus according to any one of the first to fifth aspects, wherein the transferring medium is accommodated in a first cassette, corresponding to an arrangement of the long film-like article accommodated in the cassette.

In a seventh aspect of the present invention, there is provided an apparatus according to the sixth aspect, wherein the platen is movable between a first operation position and a first retreat position, which are located to sandwich a mounting position of the first cassette, such that the platen is placed at the first retreat position before the first cassette is mounted in the apparatus, and the platen is placed at the first operation position while pushing the transferring medium out of the first cassette through an opening in the first cassette after the first cassette is mounted in the apparatus.

In an eighth aspect of the present invention, there is provided an apparatus according to the seventh aspect, wherein a heating and pressing mechanism is supported by a rotatable block common to the platen, and the apparatus comprises an operation head movable in response to movement of the platen while the platen is moved between the first operation position and the first retreat position.

In a ninth aspect of the present invention, there is provided an apparatus according to any one of the first to eighth aspects, wherein the ink ribbon is accommodated in a second cassette, corresponding to an arrangement of the long film-like article accommodated in the cassette.

In a tenth aspect of the present invention, there is provided an apparatus according to the ninth aspect, wherein the thermal head is movable between a second operation position and a second retreat position, which are located to sandwich a mounting position of the second cassette, such that the thermal head is placed at the second retreat position before the second cassette is mounted in the apparatus, and the thermal head is placed at the second operation position while pushing the ink ribbon out of the second cassette through an opening in the second cassette after the second cassette is mounted in the apparatus.

In an eleventh aspect of the present invention, there is provided an apparatus according to any one of the first to fifth aspects, wherein the transferring medium and the ink ribbon are accommodated in a common cassette, each corresponding to an arrangement of the long film-like article accommodated in the cassette.

In a twelfth aspect of the present invention, there is provided a cassette formed as the first cassette according to the sixth aspect, which accommodates a long film-like transferring medium having an image-forming layer, which allows thermal transfer recording to be performed, using an ink ribbon having an ink layer, and is separable from a substrate, wherein the transferring medium is used for forming a record-image while being fed from the cassette mounted in an image forming apparatus.

In a thirteenth aspect of the present invention, there is provided a cassette according to the twelfth aspect, wherein the cassette includes a casing, a pay-off shaft rotatably disposed on the casing to support the transferring medium in a virgin state put therearound, and a take-up shaft rotatably disposed on the casing to wind up the transferring medium in a spent state.

In a fourteenth aspect of the present invention, there is provided a cassette according to the thirteenth aspect, wherein the cassette includes openings respectively formed on two opposite surfaces of the casing between the pay-off shaft and the take-up shaft, such that an operation head of the apparatus for the transferring medium comes into the casing through one of the openings and pushes the transferring medium out of the casing through the other of the openings, when the transferring medium is used for forming the record-image.

In a fifteenth aspect of the present invention, there is provided a cassette according to the thirteenth or fourteenth aspect, wherein the pay-off shaft and the take-up shaft are detachably disposed on the casing to allow the cassette to be refilled with a transferring medium.

According to a sixteenth aspect of the present invention, there is provided an image formation method comprising:

supplying and driving a long film-like ink ribbon having an ink layer for performing thermal transfer recording;

supplying and driving a long film-like transferring medium having an image-forming layer, which allows thermal transfer recording to be performed, using the ink ribbon, and is separable from a substrate;

selectively heating the ink layer of the ink ribbon by a thermal head in a state where the transferring medium and the ink ribbon are put one on the other on a platen, thereby selectively transferring a thermal transfer recording material onto the image-forming layer to form a record-image on the image-forming layer; and applying heat and pressure to the transferring medium having the record-image and a target object, in a state where the transferring medium and the target object are put one on the other, thereby transferring the record-image along with the image-forming layer from the transferring medium to the target object;

wherein at least one long film-like article to be consumed when the record-image is formed on the image-forming layer is accommodated in a cassette detachably mounted in an image forming apparatus, and the long film-like article is used for forming the record-image while being fed from the cassette mounted in the apparatus.

In a seventeenth aspect of the present invention, there is provided a method according to the sixteenth aspect, wherein the transferring medium is accommodated in a first cassette, corresponding to an arrangement of the long film-like article accommodated in the cassette.

In an eighteenth aspect of the present invention, there is provided a method according to the seventeenth aspect, wherein the platen is movable between a first operation position and a first retreat position, which are located to sandwich a mounting position of the first cassette, the method comprising:

placing the platen at the first retreat position before the first cassette is mounted in the apparatus; and placing the platen at the first operation position while pushing the transferring medium out of the first cassette through an opening in the first cassette after the first cassette is mounted in the apparatus.

In a nineteenth aspect of the present invention, there is provided a method according to any one of the sixteenth to eighteenth aspects, wherein the ink ribbon is accommodated in a second cassette, corresponding to an arrangement of the long film-like article accommodated in the cassette.

In a twentieth aspect of the present invention, there is provided a method according to the nineteenth aspect, wherein the thermal head is movable between a second operation position and a second retreat position, which are located to sandwich a mounting position of the second cassette, the method comprising:

placing the thermal head at the second retreat position before the second cassette is mounted in the apparatus; and placing the thermal head at the second operation position while pushing the ink ribbon out of the second cassette through an opening in the second cassette after the second cassette is mounted in the apparatus.

The embodiments of the present invention include inventions at various stages, and various types of inventions can be derived from appropriate combinations of a plurality of disclosed constituent elements. For example, when an invention is derived by omitting several constituent elements shown in the embodiments, to practice the derived invention, the omitted portions are compensated for by known conventional techniques.

According to the present invention, an intermediate transfer film used as a transferring medium is accommodated in a cassette, and is set at a predetermined position in an image forming apparatus. Accordingly, near a position directly below a heating roller for performing secondary transfer, the set direction of the film relative to a predetermined position in the film width direction is prevented from carelessly shifting. As a result, it is possible to prevent such faulty-transfer relative to a target object, that an image-forming layer causes transfer positional shifts in the film width direction or transfer crinkles.

Furthermore, not only the intermediate transfer film, but also an ink ribbon used for writing a record-image preferably employs a cassette structure, thereby further suppressing contamination near the set path. As a result, it is possible to prevent image defects from being caused by foreign substances on the finally transferred matter.

In other words, even where the path of the intermediate transfer film is long and complicated, a uniform and high-quality record-image with no image defect is completed without dependence on the skill of the operator who performs setting of the intermediate transfer film and the ink ribbon.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter with reference to the accompanying drawings. In the following description, the constituent elements having substantially the same function and arrangement are denoted by the same reference symbols, and a repetitive description will be made only when necessary.

Figure 4:
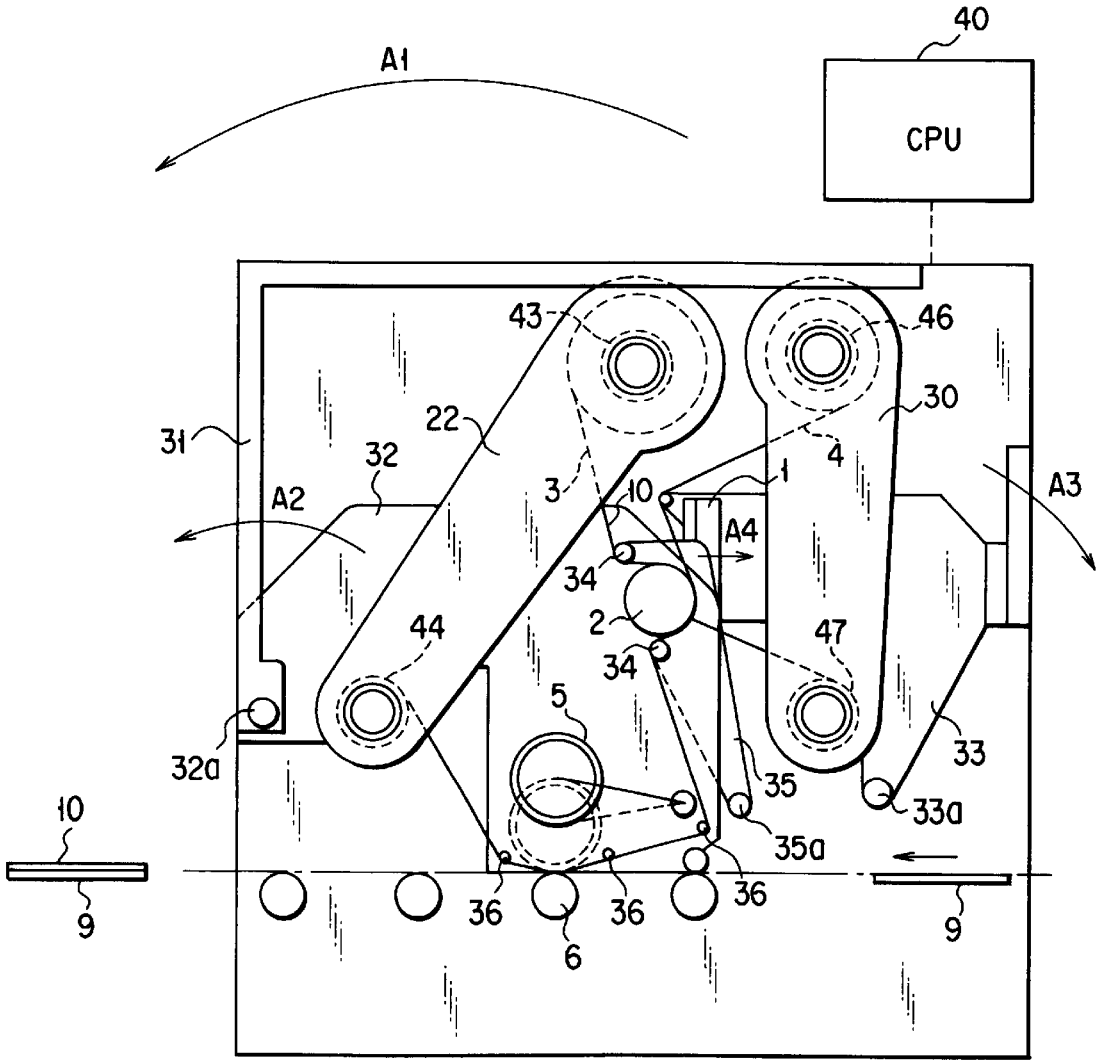
FIG. 4 is a schematic structural view showing an image forming apparatus using an indirect transferring method according to an embodiment of the present invention.

FIG. 4 is a schematic structural view showing an image forming apparatus using an indirect transferring method according to an embodiment of the present invention.

As shown in FIG. 4, an intermediate transfer film 3 and an ink ribbon 4 pass between a thermal head 1 and a platen roller 2, which work as an image forming mechanism. The ink ribbon 4 is selectively heated by the thermal head 1 while the intermediate transfer film 3 and the ink ribbon 4 are put one on the other on the platen roller 2, so that a mirror image of a record-image is formed on the image-forming layer 10 of the intermediate transfer film 3.

The intermediate transfer film 3 further passes between a heating roller 5 and a pressure roller 6, which work as a heating and pressing mechanism. A target object 9 is set on the right side in FIG. 4, and is sent between the heating roller 5 and the pressure roller 6. The intermediate transfer film 3 and the target object 9 are supplied with heat and pressure between the heating roller 5 and the pressure roller 6, so that the image-forming layer 10 (see FIG. 9) of the intermediate transfer film 3 is transferred along with the record-image onto target object 9.

More specifically, the intermediate transfer film 3 is supplied from a pay-off reel 43, passes between the thermal head 1 and the platen roller 2, further passes through the pair of rollers 5 and 6 of the heating and pressing mechanism, and is then wound up by a take-up reel 44. The intermediate transfer film 3 is put around at least part of the outer peripheral surface of the platen roller 2 by a pair of clamp rollers 34, when an image-writing operation is performed. The intermediate transfer film 3 is guided while it is supplied with tension by a plurality of guide rollers 36. Since the intermediate transfer film 3 is supplied with a suitable tension, it is possible to prevent unnecessary warps of the film 3 and trouble due to the warps.

Figure 9:
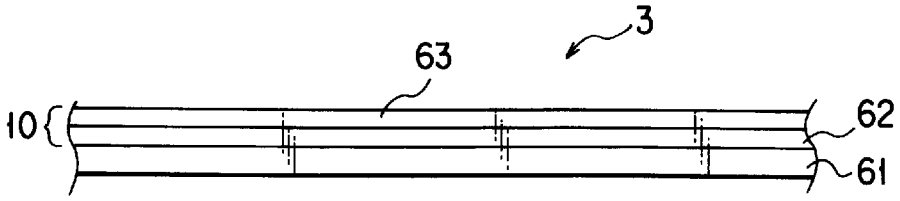
FIG. 9 is a schematic sectional view showing an intermediate transfer film to be used in the apparatus in FIG. 4.

As shown in FIG. 9, the intermediate transfer film 3 has a long film-like substrate 61, and an image-forming layer 10 laminated thereon. The image-forming layer 10 is formed of, for example, a protection layer 62 of a transparent resin and an image-receiving layer 63 of a resin. For example, a polyester based film, such as a PET based resin, having a great heat-resistance is used for the substrate 61; an acryl based resin or a PET based resin is used for the protection layer 62; and an urethane based resin, an epoxy based resin, or a mixed resin mainly containing them is used for the image-receiving layer 63. The protection layer 62 and the image-receiving layer 63 are stuck to the target object 9 by mean of heat and pressure, and can be then separated from the substrate 61.

Depending on the affinity between the materials of the image-receiving layer 63 and the target transfer surface of the target object 9, there is a case where hardly any sufficient adhesion is obtained by mean of heat and pressure. In this case, a suitable adhesive layer or sheet is disposed on one or both of the image-receiving layer 63 and the target object 9, or between them, so that an image can be formed on the target object 9.

The ink ribbon 4 is supplied from a pay-off reel 46, passes between the thermal head 1 and the platen roller 2, and is then wound up by a take-up reel 47. The ink ribbon 4 is selectively heated on the basis of image information by the thermal head 1 at a position opposite to the platen roller 2. Consequently, corresponding to the image to be recorded, the ink layer (only dyes used as coloring materials in the case of sublimation transfer) is selectively transferred to the intermediate transfer film 3 side.

Together with coloring materials (pigments or dyes) in the ink layer, binder materials are transferred to the image-receiver side, upon thermal transfer recording, where the thermal transfer recording mode is any one of the following modes, e.g., a conventional thermal fusion transfer mode in which the entire ink layer is thermally fused to perform transfer; a so-called resin type thermal transfer mode in which an ink ribbon with an ink layer rich in resin and extremely poor in (or not containing) a low-melting point material, such as wax, is used, and the ink layer is selectively heated and is softened or semi-fused, so that the ink layer is separated from a substrate onto an image-receiver side to perform thermal transfer recording; or a thermal adhesion and film-separation mode (for example, Jpn. Pat. Appln. KOKAI Publication No. 7-117359), (particularly in the case where the ink layer is very thin at about 1 $\mu$m or less). Where the components to be transferred are referred to as thermal transfer recording materials, the thermal transfer recording materials contain not only coloring materials, but also ink layer materials, such as a binder material. In this case, an area gradation method is generally used as the method of displaying gradation, and thus a thermal head, which is called a thermal heat concentration type, is preferably used.

On the other hand, where the thermal transfer recording mode is sublimation transfer recording, only coloring materials (sublimation dyes) in an ink layer are transferred to the image-receiver side by selective heating with a thermal head, while binder materials are not transferred. In other words, the thermal transfer recording materials contain only coloring materials, i.e., sublimation dyes. In this case, a density gradation method other than the area gradation method is generally used as the method of displaying gradation.

Figure 10:
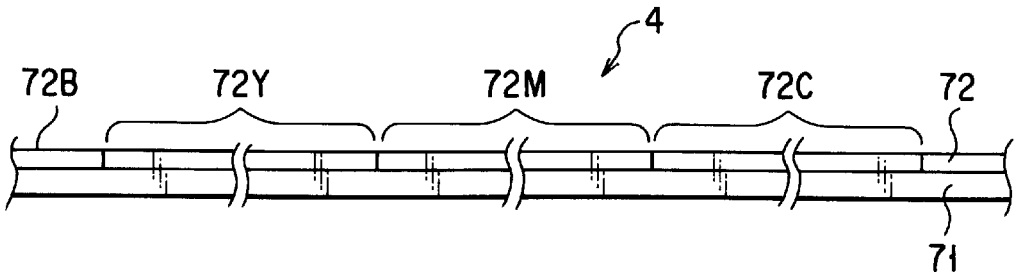
FIG. 10 is a schematic sectional view showing an ink ribbon to be used in the apparatus in FIG. 4.

As shown in FIG. 10, the thermal transfer ink ribbon 4 has a long substrate film 71, and a plurality of ink layers 72 disposed thereon and having different colors. Each of the ink layers 72 includes a coloring material selected from the group consisting of pigments and dyes. The ink layers 72 of the ribbon 4 include, for example, three color ink layers 72Y, 72M, and 72C of Y (yellow), M (magenta), and C (cyan) for forming area gradation images, and an ink layer 72B of B (black) for forming two-value images. The ink layers 72Y, 72M, 72C, and 72B of different colors in the ink ribbon 4 are sequentially and repeatedly disposed on the substrate film 71 in the supply direction of the ribbon 4, so that the respective colors have their own regions with predetermined lengths.

Other than the color ink layers of Y, M, C, and B, the ink ribbon 4 may be provided with an ink layer of a material exhibiting a different color or a special effect (for example, gold, silver, fluorescent, phosphorescent, IR-absorptive, etc.), or a layer used for a purpose other than an ink layer (an adhesive layer, a protective layer, etc., which can be thermally transferred). In this case, such an additional layer may be formed by a method of, e.g., suitably and separately applying it before, after, or between the ink layers of three primary colors in the longitudinal direction of the ink ribbon 4, depending on the design.

In the case of a thermal transfer recording mode other than the sublimation transfer mode, i.e., in the case of the thermal fusion transfer mode, the resin type thermal transfer mode, or the thermal adhesion and film-separation mode, described above, the area gradation method is generally used the method of displaying gradation. However, where a multi-colored display is also performed, the dot-on-dot method of stacking differently colored ink dots one on another at substantially the same position is used. Accordingly, where a multi-colored image with gradation is to be formed in these thermal transfer recording modes other than the sublimation transfer mode, the area gradation method and the dot-on-dot method are generally used at the same time.

The intermediate transfer film 3 with an image applied thereto is supplied with heat and pressure against the target object 9 on the pressure roller 6, by the heating roller 5, which has been moved down to an operation position at the transfer operation time. By doing so, the image-forming layer 10 including the image-receiving layer 63 with the image recorded thereon is transferred from the intermediate transfer film 3 to the target object 9.

The target object 9 is set on a tray (not shown), which is moved from the right side to the left side in the drawing by a driving mechanism, such as an actuator (not shown). A conventional technique, such as a belt or roller, may be used, other than the combination of the actuator with the tray, as means for conveying or positioning the target object 9.

The operations of the entire image forming apparatus, such as supply of the intermediate transfer film 3 and the ink ribbon 4, and drive of the thermal head 1, the platen roller 2, the heating roller 5, and the target object 9, are performed under the control of a controller 40, with reference to a program inputted into the controller 40 in advance.

When a record-image is formed, long film-like articles to be consumed, such as the intermediate transfer film 3 and the ink ribbon 4, are respectively accommodated in cassettes, so that they can be exchanged for new one by detaching and attaching the cassettes relative to the image forming apparatus. Since the relationship of the intermediate transfer film 3 relative to the cassette 22 accommodating it, and the relationship of the ink ribbon 4 relative to the cassette 30 accommodating it are common, an explanation will be given of the structure only of the cassette 22 for the intermediate transfer film 3, for example.

Figure 7:
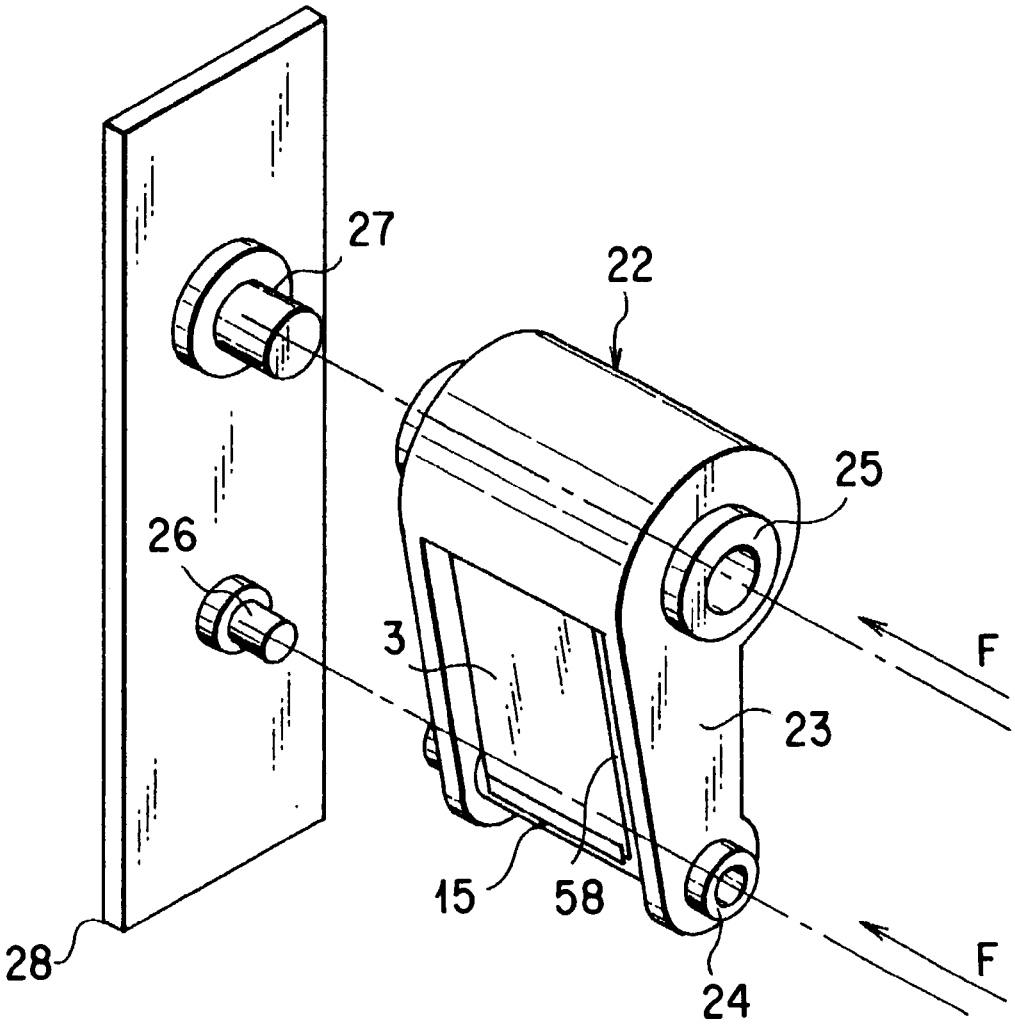
FIG. 7 is a schematic structural view showing part of the apparatus of FIG. 4 and a cassette for an intermediate transfer film to be used in the apparatus.
Figure 8A:
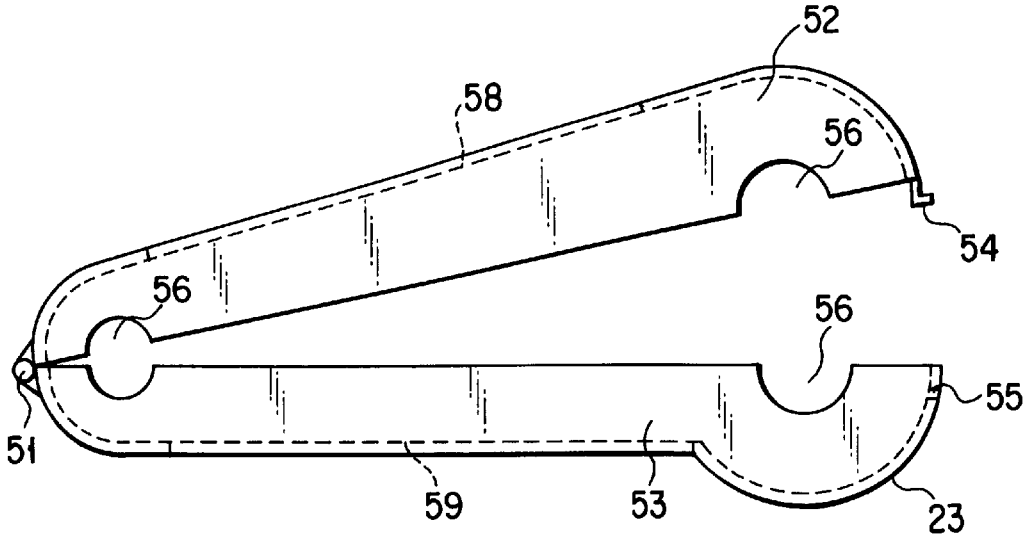
FIG. 8A is a side view showing the cassette of FIG. 7 in a state where its casing is opened.
Figure 8B:
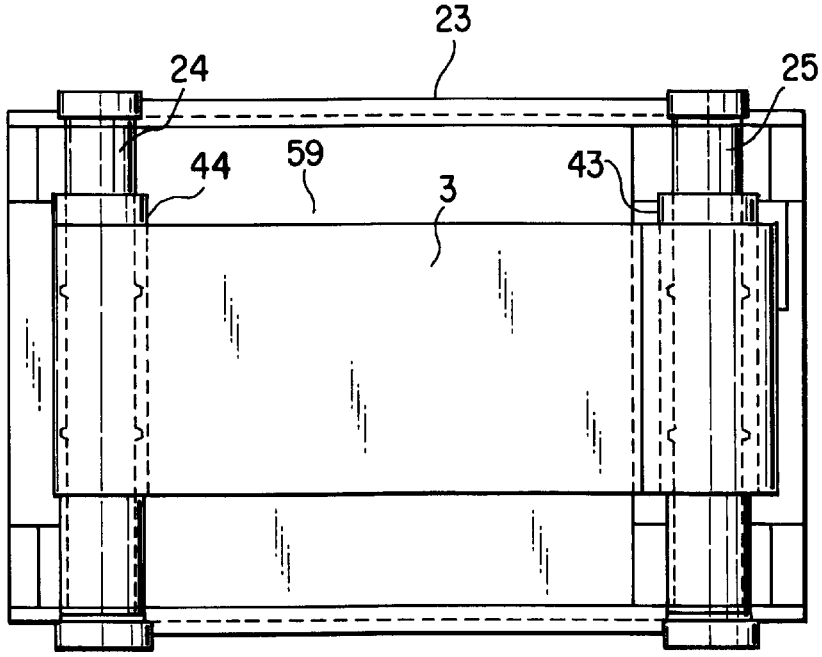
FIG. 8B is a plan view showing the internal structure of the cassette.

FIG. 7 is a perspective view showing part of the image forming apparatus and the cassette 22 for the intermediate transfer film 3. FIG. 8A is a side view showing the cassette 22 in a state where its casing is opened, and FIG. 8B is a plan view showing the internal structure of the cassette 22.

The cassette 22 has a casing 23 made of a material, such as metal or resin. The casing 23 is formed of an upper frame 52 and a lower frame 53, which are opened/closed by rotating them about an axis 51. The upper frame 52 is provided with a hook 54 at its end, while the lower frame 53 is provided with a slit 55 at its end to engage with the hook 54. When the casing 23 is closed, the hook 54 engages with the slit 55, so that the upper frame 52 is fixed to the lower frame 53.

Two pairs of bearing holes 56 are formed in the sides of the casing 23. A take-up cylinder (a hollow shaft) 24 and a pay-off cylinder (a hollow shaft) 25 are respectively and rotationally supported by the bearing holes 56. The take-up reel 44 and the pay-off reel 43 are respectively and detachably fixed to the cylinders 24 and 25, for placing a film around them. A new roll of the intermediate transfer film 3 is fixed to the pay-off reel 43 in advance, and the distal end of the film 3 is fixed to a predetermined position of the take-up reel 44 in advance by, e.g., a fixing tape 15. When necessary, the casing 23 is opened, and the cylinders 24 and 25 are taken out of the casing 23, so that the roll of the intermediate transfer film 3 can be exchanged for a new one, along with the reels 44 and 43.

Openings 58 and 59 are respectively formed in the opposite surfaces of the casing 23 between the cylinders 24 and 25, i.e., in the upper frame 52 and lower frame 53. The openings 58 and 59 have sizes and shapes to allow operation head components, such as the platen roller 2 and the heating roller 5, to come into the casing 23 through the opening 58 on one side and push the intermediate transfer film 3 out of the casing 23 through the opening 59 on the other side, in a manner as described later, when the intermediate transfer film 3 is used for forming a record-image.

The image forming apparatus is provided with a mounting section 28 for mounting the cassette 22. In the mounting section 28, a take-up axis connector (solid shaft) 26 and a pay-off axis connector (solid shaft) 27 for connecting the take-up cylinder 24 and the pay-off cylinder 25 of the cassette 22 are disposed to be rotatable about respective axes. The take-up axis connector 26 is rotatable by a motor (not shown) in at least one direction. The take-up axis connector 26 functions as a driving shaft for driving the intermediate transfer film 3, so that the intermediate transfer film 3 runs from the pay-off reel 43 to the take-up reel 44.

When the cassette 22 is mounted, the cassette 22 is first positioned relative to the mounting section 28 such that the axial center of the take-up cylinder 24 aligns with that of the take-up axis connector 26, and the axial center of the pay-off cylinder 25 aligns with that of the pay-off axis connector 27. Then, pressure is applied by a holder (not shown) in an arrow F direction shown in FIG. 7, the cylinder 24 is fixed to the axis connector 26 on the take-up side, and the cylinder 25 is fixed to the axis connector 27 on the pay-off side.

The cassette 30 for the ink ribbon 4 also has the same internal structure, mounting structure, driving structure, and so forth, as the cassette 22 for intermediate transfer film 3, as described above.

In order to facilitate mounting of the cassettes 22 and 30 in the image forming apparatus, operation head components for the intermediate transfer film 3 and the ink ribbon 4 can be moved at least between an operation position and a retreat position.

More specifically, members, such as the platen roller 2, the heating roller 5, and the guide roller 36, to come into contact with the intermediate transfer film 3 when a record-image is formed are supported on a left block 32. The left block 32 is swingable about an axis 32*a* in an arrow A2 direction, so that the platen roller 2, the heating roller 5, the guide roller 36, and so forth are movable, by swinging the left block 32, between an operation position and a retreat position which are located to sandwich the mounting position of the cassette 22.

Similarly, members, such as the thermal head 1, to come into contact with the ink ribbon 4 when a record-image is formed are supported on a right block 33. The right block 33 is swingable about an axis 33*a* in an arrow A3 direction, so that the thermal head 1 and so forth are movable, by swinging the right block 33, between an operation position and a retreat position which are located to sandwich the mounting position of the cassette 30.

Furthermore, the pair of clamp rollers 34, which is used for holding the intermediate transfer film 3 on the platen roller 2 when an image-writing operation is performed, are supported on a central block 35. The central block 35 is swingable about an axis 35*a* in an arrow A4 direction. The upper cover 31 of the apparatus is also swingable about an axis 31*a* in an arrow A1 direction.

Figure 5:
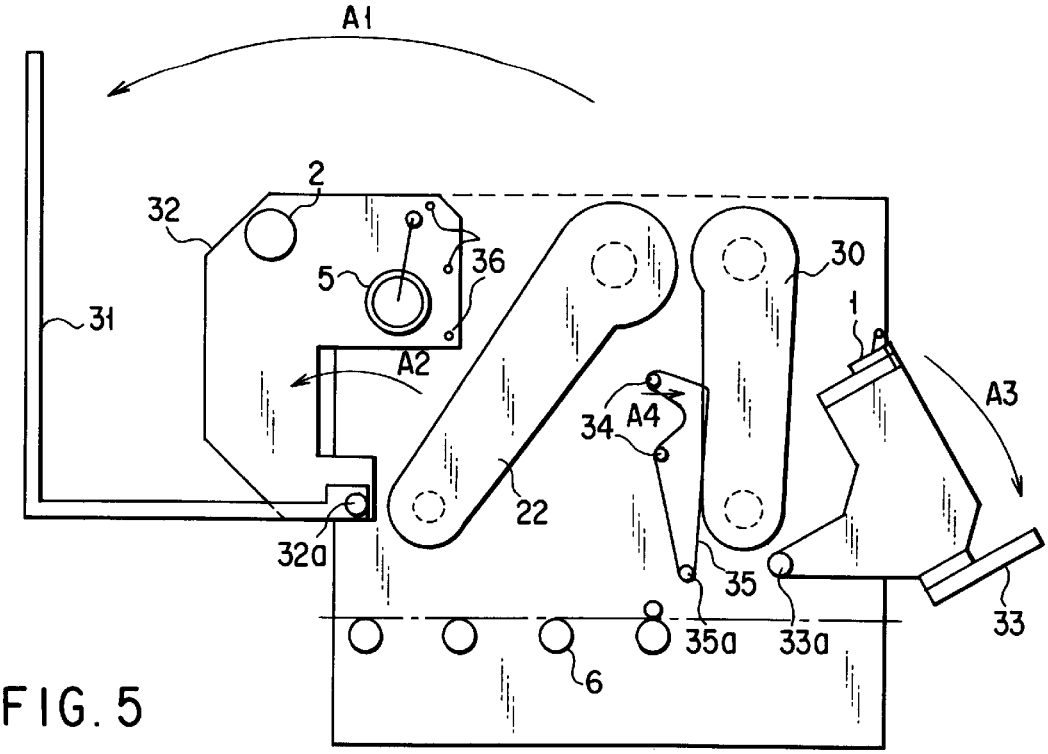
FIG. 5 is a schematic structural view showing the apparatus of FIG. 4 in a state where it is opened.
Figure 6:
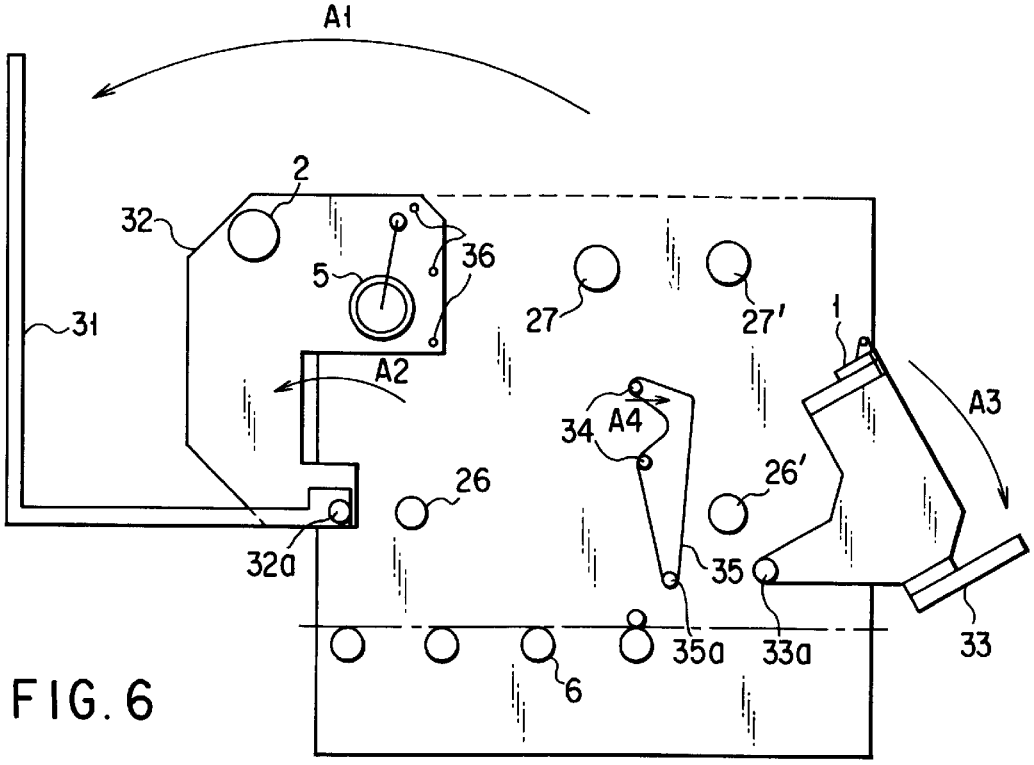
FIG. 6 is a schematic structural view showing the apparatus of FIG. 4 in a state where it is opened and cassettes are removed.

FIG. 5 is a schematic structural view showing the image forming apparatus of FIG. 4 in a state where it is opened. FIG. 6 is a schematic structural view showing the image forming apparatus of FIG. 4 in a state where it is opened and the cassettes 22 and 30 are removed.

When the cassettes 22 and 30 are replaced, in the state shown in FIG. 4, the upper cover 31 and the door panel of the right block 33 are opened, and the upper cover 31 and the right block 33 are rotated in the arrow A1 direction and the arrow A3 direction, respectively, to the positions shown in FIG. 5. The central block 35 is biased by a spring in the arrow A4 direction, and thus is automatically moved to the position shown in FIG. 5 upon the right block 33 being opened. Then, the left block 32 is rotated in the arrow A2 direction to the position shown in FIG. 5.

By doing so, the platen roller 2, the heating roller 5, the guide roller 36, and so forth on the left block 32 are moved from the operation position shown in FIG. 4, through the openings 58 and 59 of the cassette 22, to the retreat position shown in FIG. 5. Consequently, the cassette 22 is released from the left block 32, and the intermediate transfer film 3, which has been pushed out from the cassette 22 by the platen roller 2 and so forth, is released from the platen roller 2 and so forth. Similarly, the thermal head 1 and so forth on the right block 33 are moved from the operation position shown in FIG. 4, through the openings of the cassette 30, to the retreat position shown in FIG. 5. Consequently, the cassette 30 is released from the right block 33, and the ink ribbon 4, which has bee pushed out from the cassette 30 by the thermal head 1 and so forth, is released form the thermal head 1. It follows that the used cassettes 22 and 30, which are now free, can be easily taken out of the image forming apparatus (the state shown in FIG. 6).

Then, a new cassette 22 is inserted along a guide (not shown) into the image forming apparatus. Then, pressure is automatically or manually applied in an arrow F direction, so that the cylinders 24 and 25 of the cassette 22 are respectively fixed to the axis connectors 26 and 27 of the apparatus. With similar steps, a new cassette 30 is mounted at a predetermined position (shown as axis connectors 26' and 27') in the image forming apparatus. The state immediately after the new cassettes 22 and 30 are mounted, as described above, is substantially the same as that shown in FIG. 5.

Then, the left block 32 and the right block 33 are rotated in directions opposite to the arrow A2 direction and the arrow A3 direction, respectively, to the positions shown in FIG. 4. During this time, the central block 35 is pushed by the right block 33, and is moved in a direction opposite to the arrow A4 direction. Consequently, the platen roller 2, the heating roller 5, the guide roller 36, and so forth on the left block 32 are moved from the retreat position shown in FIG. 5 to the operation position shown in FIG. 4, while pushing the intermediate transfer film 3 out of the cassette 22 through the openings 58 and 59 of the cassette 22. Similarly, the thermal head 1 and so forth on the right block 33 are moved from the retreat position shown in FIG. 5 to the operation position shown in FIG. 4, while pushing the ink ribbon 4 out of the cassette 30 through the openings of the cassette 30. As a result, the apparatus is set in the state shown in FIG. 4 in which it can start operating.

Figure 1:
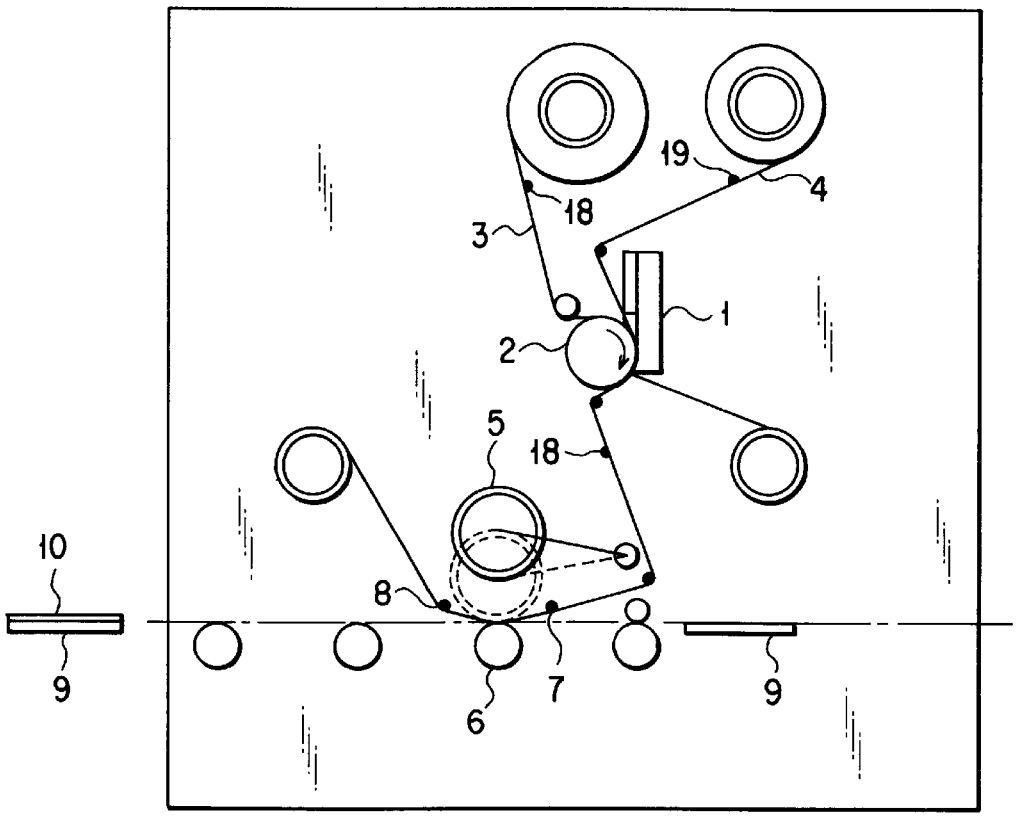
FIG. 1 is a schematic structural view showing an image forming apparatus using a conventional indirect transferring method.
Figure 2:
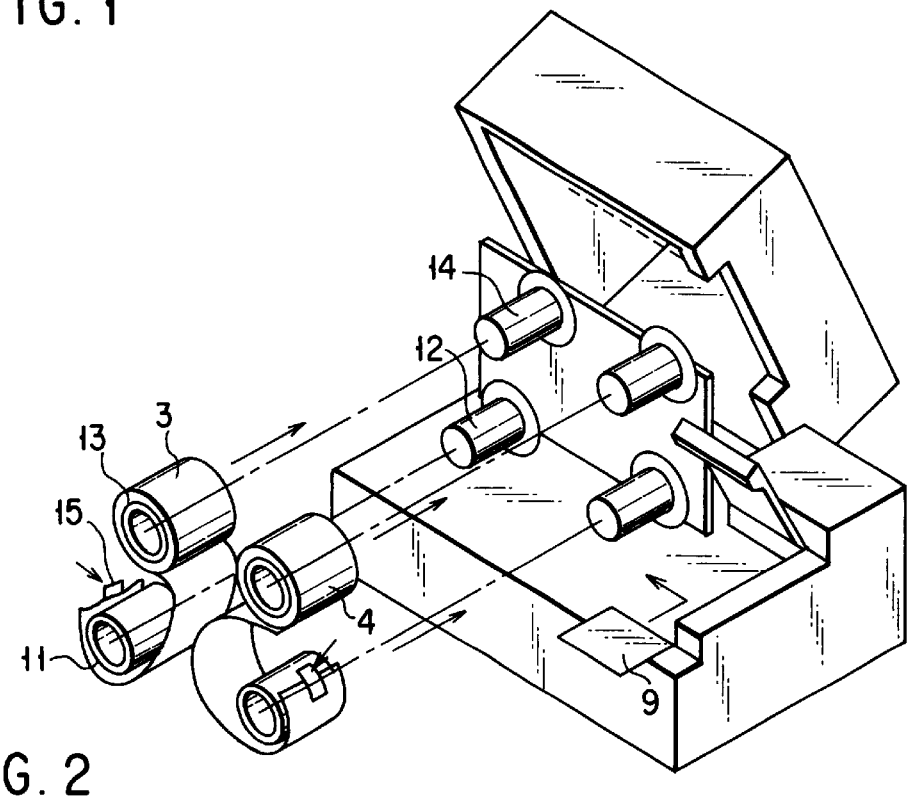
FIG. 2 a perspective view showing a setting method of an intermediate transfer film and an ink ribbon in the apparatus shown in FIG. 1.
Figure 3A:
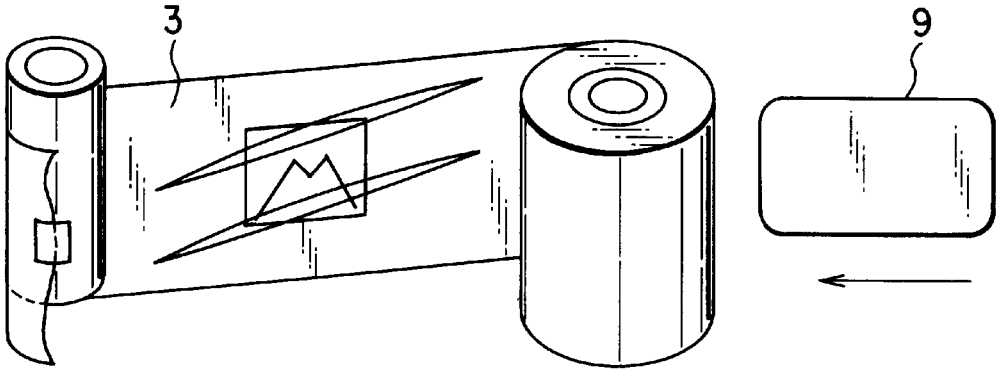
FIGS. 3A, 3B, 3C, 3D, and 3E are views for explaining problems caused in the apparatus shown in FIG. 1.
Figure 3B:
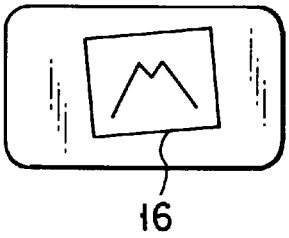
Figure 3C:
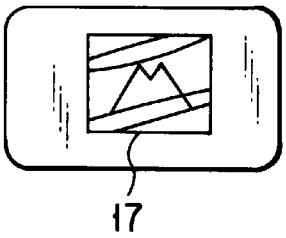
Figure 3D:
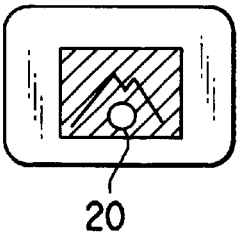
Figure 3E:
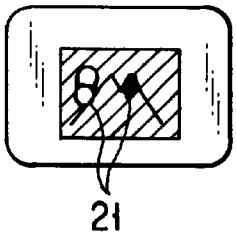

With the image forming apparatus shown in FIG. 4, the intermediate transfer film 3 and the ink ribbon 4 can be replaced only by rotating the left and right blocks 32 and 33, and mounting the cassettes 22 and 30. Accordingly, the replacement time is shortened, as compared to the prior art shown in FIG. 2, and thus the upper cover 31 needs to be left open for a shorter time, thereby preventing outside dust from entering. Furthermore, when the replacement operation is performed, the operator does not have to touch any key part of image formation, such as the intermediate transfer film 3, the ink ribbon 4, the thermal head 1, or the platen roller 2, thereby preventing the key parts from being contaminated. Accordingly, the possibility of image defects 20 or 21, as shown in FIGS. 3D and 3E, being generated becomes lower.

In the cassette 22 for the intermediate transfer film 3, since the path of the intermediate transfer film 3 is short and straight, the distal end of the intermediate transfer film 3 can be accurately fixed to the take-up reel 44. Furthermore, the intermediate transfer film 3 can be set in a state, in which it can start operating, by rotating the left block 32 to move the platen roller 2, the heating roller 5, the guide roller 36, and so forth to the operation position, while pushing out the intermediate transfer film 3. As a result, the film is prevented from skewing, which may cause transfer positional shift or a transfer crinkle.

The distal end of the intermediate transfer film 3 may be fixed to the take-up reel 44, when the cassette 22 is manufactured or immediately before the cassette 22 is mounted in the image forming apparatus. The cassette 22 may be disposable, or refilled with an intermediate transfer film 3 to recycle the casing 23 and the cylinders 24 and 25. These options are also available to the cassette 30 for the ink ribbon 4.

Figure 11:
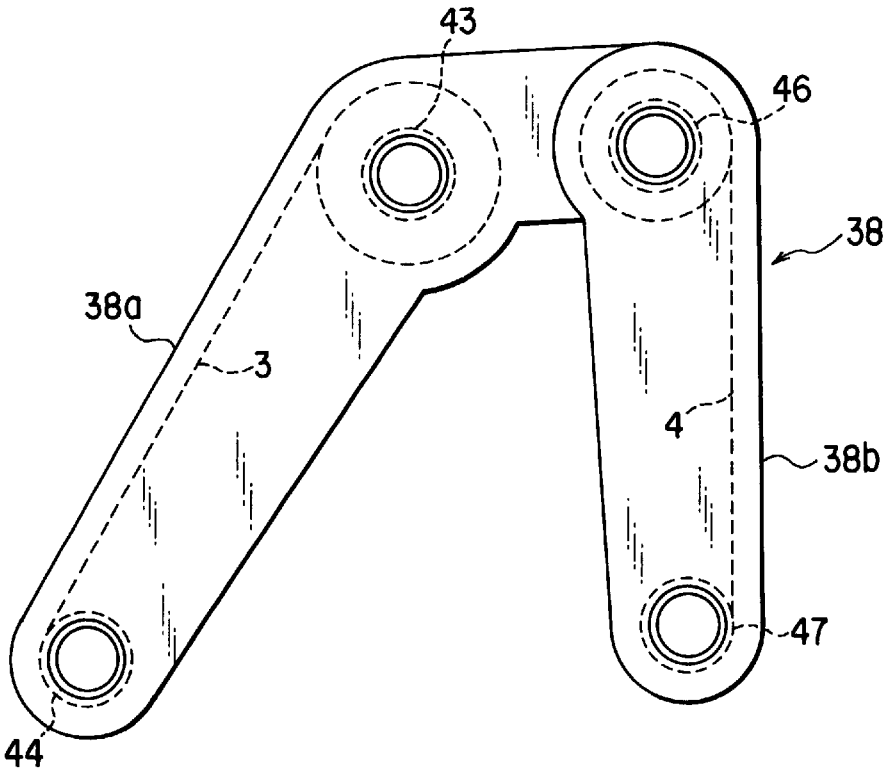
FIG. 11 is a side view showing a common cassette for an intermediate transfer film and an ink ribbon to be used in the apparatus in FIG. 4.

As shown in FIG. 11, the intermediate transfer film 3 and the ink ribbon 4 may be accommodated in a common cassette 38, according to another embodiment. A cassette portion 38*a* for accommodating the intermediate transfer film 3 and a cassette portion 38*b* for accommodating the ink ribbon 4 have structures corresponding to the cassettes 22 and 30, respectively. In this case, the cassette portions 38*a* and 38*b* are preferably connected to be rotatable relative to each other, so that the angle between the portions 38*a* and 38*b* is adjustable, in light of storage of the cassette 38.

The left and right blocks 32 and 33 may be designed to be stationary, even where the cassettes 22 and 30 for the intermediate transfer film 3 and the ink ribbon 4 are used. In this case, the intermediate transfer film 3 and the ink ribbon 4 can be accurately fixed to the take-up reels 44 and 47, but the paths of the intermediate transfer film 3 and the ink ribbon 4 have to be manually formed to be ready for starting an operation.

In the embodiments described above, the intermediate transfer film 3 and the ink ribbon 4 are shown as typical examples of a long film-like article accommodated in a cassette. However, there is a case where an image forming apparatus is designed to supply another transfer film, such as a transfer film for transferring a protective overlay layer to protect a record-image on a target object 9, or a transfer film for transferring an adhesive layer or an anti-forgery layer onto the target transfer surface of a target object or the image formation surface, with an image formed thereon, of an intermediate transfer film. In this case, the other transfer film may be arranged as a long film-like article accommodated in a cassette. In the embodiments described above, the present invention is exemplified mainly with image formation by means of thermal fusion transfer or the like, but the present invention may be applied in a similar manner to image formation by means of sublimation transfer using sublimation dyes.

Furthermore, in the embodiments described above, when an image is recorded on a transferring medium (e.g., an intermediate transfer film 3, as in the embodiments) by means of thermal transfer recording with an ink ribbon, a platen of a roller type (the platen roller 2) is used, but a platen having a shape other than a roller may be employed, as required. In this respect, a transferring medium may be supported by a platen while, for example, it is placed and pushed thereon, rather than being put around, as required.

Various types of modifications and changes within the spirit of the present invention may be anticipated by a person skilled in the art. It is to be understood that these modifications and changes belong to the scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a mechanism configured to supply and drive a long film-like ink ribbon having an ink layer that performs thermal transfer recording;

a mechanism configured to supply and drive a long film-like transferring medium having an image-forming layer, which allows thermal transfer recording to be performed, using the ink ribbon, and is separable from a substrate;

a platen configured to support the transferring medium when thermal transfer recording is performed on the image-forming layer, using the ink ribbon;

a thermal head configured to selectively heat the ink layer of the ink ribbon in a state where the transferring medium and the ink ribbon are put one on the other on the platen, thereby selectively transferring a thermal transfer recording material onto the image-forming layer to form a record-image on the image-forming layer; and a heating and pressing mechanism configured to apply heat and pressure to the transferring medium having the record-image and a target object, in a state where the transferring medium and the target object are put one on the other, thereby transferring the record-image along with the image-forming layer from the transferring medium to the target object, wherein the transferring medium is accommodated in a first cassette detachably mounted in the apparatus, and the transferring medium is used to form the record-image while being fed from the first cassette mounted in the apparatus, and the platen is movable between a first operation position and a first retreat position which are located to sandwich a mounting position of the first cassette, such that the platen is placed at the first retreat position before the first cassette is mounted in the apparatus and the platen is placed at the first operation position while pushing the transferring medium out of the first cassette through an opening in the first cassette after the cassette is mounted in the apparatus.

2. An apparatus according to claim 1, wherein the first cassette includes a casing, a pay-off shaft rotatably disposed on the casing to support the transferring medium in a virgin state put therearound, and a take-up shaft rotatably disposed on the casing to wind up the transferring medium in the spent state.

3. An apparatus according to claim 2, wherein the first cassette includes openings respectively formed on two opposite surfaces of the casing between the pay-off shaft and the take-up shaft, such that the platen comes into the casing through one of the openings and pushes the transferring medium out of the casing through the other of the openings, when the transferring medium is used to form the record-image.

4. An apparatus according to claim 2, wherein the pay-off shaft and the take-up shaft are detachably disposed on the casing to allow the first cassette to be refilled with a transferring medium.

5. An apparatus according to claim 2, wherein the apparatus comprises first and second axis connectors configured to respectively attach the pay-off shaft and the take-up shaft thereto, the second axis connector functioning as a driving shaft to drive the transferring medium.

6. An apparatus according to claim 1, wherein a heating and pressing mechanism is supported by a rotatable block common to the platen, and the apparatus comprises an operation head movable in response to movement of the platen while the platen is moved between the first operation position and the first retreat position.

7. An apparatus according to claim 1, wherein the ink ribbon is accommodated in a second cassette detachably mounted in the apparatus.

8. An apparatus according to claim 7, wherein the thermal head is movable between a second operation position and a second retreat position, which are located to sandwich a mounting position of the second cassette, such that the thermal head is placed at the second retreat position before the second cassette is mounted in the apparatus, and the thermal head is placed at the second operation position while pushing the ink ribbon out of the second cassette through an opening in the second cassette after the second cassette is mounted in the apparatus.

9. An image formation method comprising:

supplying and driving a long film-like ink ribbon having an ink layer to perform thermal transfer recording;

supplying and driving a long film-like transferring medium having an image-forming layer, which allows thermal transfer recording to be performed, using the ink ribbon, and is separable from a substrate;

selectively heating the ink layer of the ink ribbon by a thermal head in a state where the transferring medium and the ink ribbon are put one on the other by a platen, thereby selectively transferring the ink layer onto the image-forming layer to form a record-image on the image-forming layer;

applying heat and pressure to the transferring medium having the record-image and a target object, in a state where the transferring medium and the target object are put one on the other, thereby transferring the record-image along with the image-forming layer from the transferring medium to the target object, wherein the transferring medium is accommodated in a cassette detachably mounted in an image forming apparatus, and the transferring medium is used for forming the record-image while being fed from the cassette mounted in the apparatus, and the platen is movable between an operation position and a retreat position, which are located to sandwich a mounting position of the cassette;

placing the platen at the retreat position before the cassette is mounted in the apparatus, and placing the platen at the operation position while pushing the transferring medium out of the cassette through an opening in the cassette after the cassette is mounted in the apparatus.

10. An image forming apparatus comprising:

a mechanism configured to supply and drive a long film-like ink ribbon having an ink layer that performs thermal transfer recording;

a mechanism configured to supply and drive a long film-like transferring medium having an image-forming layer, which allows thermal transfer recording to be performed, using the ink ribbon, and is separable from a substrate;

a platen configured to support the transferring medium when thermal transfer recording is performed on the image-forming layer, using the ink ribbon;

a thermal head configured to selectively heat the ink layer of the ink ribbon in a state where the transferring medium and the ink ribbon are put one on the other on the platen, thereby selectively transferring the ink layer onto the image-forming layer to form a record-image on the image-forming layer; and a heating and pressing mechanism configured to apply heat and pressure to the transferring medium having the record-image and a target object, in a state where the transferring medium and the target object are put one on the other, thereby transferring the record-image along with the image forming layer from the transferring medium to the target object, wherein the ink ribbon is accommodated in a cassette detachably mounted in the apparatus, and the ink ribbon is used to form the record-image while being fed from the cassette mounted in the apparatus, and the thermal head is movable between an operation position and a retreat position which are located to sandwich a mounting position of the cassette, such that the thermal head is placed at the retreat position before the cassette is mounted in the apparatus, and the thermal head is placed at the operation position while pushing the ink ribbon out of the cassette through an opening in the cassette after the cassette is mounted in the apparatus.

11. An apparatus according to claim 10, wherein the cassette includes a casing, a pay-off shaft rotatably disposed on the casing to support the ink ribbon in a virgin state put therearound, and a take-up shaft rotatably disposed on the casing to wind up the ink ribbon in a spent state.

12. An apparatus according to claim 11, wherein the cassette includes openings respectively formed on two opposite surfaces of the casing between the pay-off shaft and the take-up shaft, such that the thermal head comes into the casing through one of the openings and pushes the ink ribbon out of the casing through the other of the openings, when the ink ribbon is used to form the record-image.

13. An apparatus according to claim 11, wherein the pay-off shaft and the take-up shaft are detachably disposed on the casing to allow the cassette to be refilled with an ink ribbon.

14. An apparatus according to claim 11, wherein the apparatus comprises first and second axis connectors configured to respectively attach the pay-off shaft and the take-up shaft thereto, the second axis connector functioning as a driving shaft to drive the ink ribbon.

15. An image formation method comprising:

supplying and driving a long film-like ink ribbon having an ink layer to perform thermal transfer recording;

supplying and driving a long film-like transferring medium having an image-forming layer, which allows thermal transfer recording to be performed, using the ink ribbon, and is separable from a substrate;

selectively heating the ink layer of the ink ribbon by a thermal head in a state where the transferring medium and the ink ribbon are put one on the other on a platen, thereby selectively transferring the ink layer onto the image-forming layer to form a record-image on the image-forming layer;

applying heat and pressure to the transferring medium having the record-image and a target object, in a state where the transferring medium and the target object are put one on the other, thereby transferring the record-image along with the image-forming layer from the transferring medium to the target object, wherein the ink ribbon is accommodated in a cassette detachably mounted in an image forming apparatus, and the ink ribbon is used for forming the record-image while being fed from the cassette mounted in the apparatus, and the thermal head is movable between an operation position and a retreat position, which are located to sandwich a mounting position of the cassette;

placing the thermal head at the retreat position before the cassette is mounted in the apparatus; and placing the thermal head at the operation position while pushing the ink ribbon out of the cassette through an opening in the cassette after the cassette is mounted in the apparatus.

* * * * *